US008360887B2

(12) United States Patent
Buchholz

(10) Patent No.: US 8,360,887 B2
(45) Date of Patent: Jan. 29, 2013

(54) WAGERING GAME SERVER AVAILABILITY BROADCAST MESSAGE SYSTEM

(75) Inventor: Dale R. Buchholz, Palatine, IL (US)

(73) Assignee: WMS Gaming Inc., Waukegan, IL (US)

( * ) Notice: Subject to any disclaimer, the term of this patent is extended or adjusted under 35 U.S.C. 154(b) by 747 days.

(21) Appl. No.: 12/278,842

(22) PCT Filed: Feb. 9, 2007

(86) PCT No.: PCT/US2007/003536

§ 371 (c)(1),
(2), (4) Date: Oct. 12, 2009

(87) PCT Pub. No.: WO2007/092608

PCT Pub. Date: Aug. 16, 2007

(65) Prior Publication Data

US 2010/0029375 A1 Feb. 4, 2010

Related U.S. Application Data

(60) Provisional application No. 60/743,259, filed on Feb. 9, 2006, provisional application No. 60/743,902, filed on Mar. 29, 2006.

(51) Int. Cl.
*A63F 9/24* (2006.01)

(52) U.S. Cl. ..... 463/42; 463/16; 463/17; 463/18; 463/19; 463/20; 463/25; 463/29

(58) Field of Classification Search ..... 463/25, 463/29, 42, 16–20
See application file for complete search history.

(56) References Cited

U.S. PATENT DOCUMENTS

| | | | | |
|---|---|---|---|---|
| 4,670,857 | A | | 6/1987 | Rackman |
| 5,116,055 | A | | 5/1992 | Tracy |
| 5,249,800 | A | | 10/1993 | Hilgendorf et al. |
| 5,280,909 | A | | 1/1994 | Tracy |
| 5,611,730 | A | | 3/1997 | Weiss |
| 5,638,448 | A | | 6/1997 | Nguyen |
| 5,762,552 | A | * | 6/1998 | Vuong et al. ..... 463/25 |
| 5,766,076 | A | | 6/1998 | Pease et al. |
| 5,823,879 | A | | 10/1998 | Goldberg et al. |
| 5,851,149 | A | | 12/1998 | Xidos et al. |
| 5,855,515 | A | | 1/1999 | Pease et al. |
| 5,885,158 | A | | 3/1999 | Torango et al. |
| 5,964,660 | A | | 10/1999 | James et al. |

(Continued)

FOREIGN PATENT DOCUMENTS

| | | |
|---|---|---|
| WO | WO-97/38540 A1 | 9/1997 |
| WO | WO-01/48713 A1 | 7/2001 |

(Continued)

OTHER PUBLICATIONS

"U.S. Appl. No. 10/629,110, Non-Final Office Action mailed Jun. 3, 2008", 12 pgs.

(Continued)

*Primary Examiner* — Peter DungBa Vo
*Assistant Examiner* — Steve Rowland
(74) *Attorney, Agent, or Firm* — Schwegman, Lundberg & Woessner, P.A

(57) ABSTRACT

A computerized wagering game system includes a gaming module operable to conduct a wagering game on which monetary value can be wagered, and a network module operable to detect a wagering game network server availability broadcast signal. The network module connects to the wagering game network server identified in the availability broadcast signal, and authenticates the identity of the wagering game network server.

12 Claims, 6 Drawing Sheets

U.S. PATENT DOCUMENTS 5,971,271 A 10/1999 Wynn et al.
6,035,397 A 3/2000 Campinos et al.
6,058,389 A 5/2000 Chandra et al.
6,061,274 A 5/2000 Thibault et al.
6,135,887 A 10/2000 Pease et al.
6,178,510 B1 1/2001 O'Connor et al.
6,183,366 B1 2/2001 Goldberg et al.
6,203,010 B1 3/2001 Jorasch
6,280,328 B1 8/2001 Holch et al.
6,289,382 B1 9/2001 Bowman-Amuah
6,312,333 B1 11/2001 Acres
6,319,125 B1 11/2001 Acres
6,358,149 B1 3/2002 Schneider
6,360,256 B1 * 3/2002 Lim ..... 709/223
6,374,357 B1 4/2002 Mohammed et al.
6,390,917 B1 5/2002 Walker et al.
6,468,155 B1 10/2002 Zucker et al.
6,473,829 B1 10/2002 Dahman et al.
6,508,709 B1 1/2003 Karmarkar
6,645,077 B2 11/2003 Rowe
6,682,423 B2 1/2004 Brosnan et al.
6,773,344 B1 8/2004 Gabai et al.
6,790,142 B2 9/2004 Okada et al.
6,830,515 B2 12/2004 Rowe
6,887,154 B1 5/2005 Luciano, Jr.
6,890,259 B2 5/2005 Breckner et al.
6,908,391 B2 6/2005 Gatto et al.
6,916,247 B2 7/2005 Gatto et al.
6,922,685 B2 7/2005 Greene et al.
6,935,958 B2 8/2005 Nelson
6,939,234 B2 9/2005 Beatty
RE38,812 E 10/2005 Acres et al.
6,997,803 B2 2/2006 LeMay et al.
7,025,674 B2 4/2006 Adams et al.
7,039,701 B2 5/2006 Wesley
7,043,641 B1 5/2006 Martinek
7,056,217 B1 6/2006 Pelkey et al.
7,062,556 B1 6/2006 Chen et al.
7,117,349 B2 10/2006 Chu et al.
7,131,909 B2 11/2006 Rowe
7,159,007 B2 1/2007 Stawikowski
7,168,089 B2 1/2007 Nguyen et al.
7,185,342 B1 2/2007 Carrer et al.
7,186,181 B2 3/2007 Rowe
7,188,085 B2 3/2007 Pelletier
7,865,959 B1 * 1/2011 Lewis ..... 726/26
2001/0014881 A1 8/2001 Drummond et al.
2001/0039210 A1 11/2001 St. Denis
2001/0044337 A1 11/2001 Rowe et al.
2001/0044339 A1 11/2001 Cordero et al.
2002/0013174 A1 1/2002 Murata
2002/0115487 A1 8/2002 Wells
2002/0143819 A1 10/2002 Han et al.
2002/0147049 A1 10/2002 Carter, Sr.
2002/0155891 A1 10/2002 Okada et al.
2002/0161868 A1 10/2002 Paul et al.
2002/0165023 A1 11/2002 Brosnan et al.
2002/0174160 A1 11/2002 Gatto et al.
2003/0004961 A1 1/2003 Slothouber et al.
2003/0013531 A1 1/2003 Rowe et al.
2003/0027625 A1 2/2003 Rowe
2003/0028480 A1 2/2003 Rowe
2003/0061404 A1 3/2003 Atwal et al.
2003/0064771 A1 4/2003 Morrow et al.
2003/0064801 A1 4/2003 Breckner et al.
2003/0064805 A1 4/2003 Wells
2003/0065805 A1 4/2003 Barnes, Jr.
2003/0069074 A1 4/2003 Jackson
2003/0078103 A1 4/2003 LeMay et al.
2003/0084342 A1 5/2003 Girard
2003/0087683 A1 5/2003 Gatto et al.
2003/0088421 A1 5/2003 Maes et al.
2003/0100369 A1 5/2003 Gatto et al.
2003/0100370 A1 5/2003 Gatto et al.
2003/0100371 A1 5/2003 Gatto et al.
2003/0100372 A1 5/2003 Gatto et al.
2003/0104865 A1 6/2003 Itkis et al.
2003/0110242 A1 6/2003 Brown et al.
2003/0130040 A1 7/2003 Dripps
2003/0154216 A1 8/2003 Arnold et al.
2003/0171149 A1 9/2003 Rothschild
2003/0188019 A1 10/2003 Wesley
2003/0208638 A1 11/2003 Abrams et al.
2003/0212818 A1 11/2003 Klein et al.
2003/0217139 A1 11/2003 Burbeck et al.
2003/0220835 A1 11/2003 Barnes, Jr.
2003/0228907 A1 12/2003 Gatto et al.
2003/0229900 A1 12/2003 Reisman
2003/0232650 A1 12/2003 Beatty
2004/0002384 A1 1/2004 Multerer et al.
2004/0002385 A1 1/2004 Nguyen
2004/0003039 A1 1/2004 Humphrey et al.
2004/0015608 A1 1/2004 Ellis et al.
2004/0031058 A1 2/2004 Reisman
2004/0048669 A1 3/2004 Rowe
2004/0063497 A1 4/2004 Gould
2004/0087367 A1 5/2004 Hendrickson
2004/0106454 A1 6/2004 Walker et al.
2004/0127277 A1 7/2004 Walker et al.
2004/0133485 A1 7/2004 Schoonmaker et al.
2004/0142744 A1 7/2004 Atkinson et al.
2004/0152511 A1 8/2004 Nicely et al.
2004/0158471 A1 8/2004 Davis et al.
2004/0162144 A1 8/2004 Loose et al.
2004/0180721 A1 9/2004 Rowe
2004/0185936 A1 9/2004 Block et al.
2004/0193867 A1 9/2004 Zimmer et al.
2004/0198496 A1 10/2004 Gatto et al.
2004/0229684 A1 11/2004 Blackburn et al.
2004/0229699 A1 11/2004 Gentles et al.
2004/0235563 A1 11/2004 Blackburn et al.
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248645 A1 12/2004 Blackburn et al.
2004/0259640 A1 * 12/2004 Gentles et al. ..... 463/42
2004/0266523 A1 * 12/2004 Gentles et al. ..... 463/29
2004/0266532 A1 12/2004 Blackburn et al.
2005/0027871 A1 2/2005 Bradley et al.
2005/0032577 A1 2/2005 Blackburn et al.
2005/0037837 A1 2/2005 Rowe
2005/0054445 A1 3/2005 Gatto et al.
2005/0086286 A1 4/2005 Gatto et al.
2005/0088980 A1 4/2005 Olkkonen et al.
2005/0153778 A1 * 7/2005 Nelson et al. ..... 463/42
2005/0192099 A1 9/2005 Nguyen et al.
2005/0227768 A1 10/2005 Blackburn et al.
2005/0282628 A1 12/2005 Beatty et al.
2005/0283522 A1 12/2005 Parkkinen et al.
2006/0073887 A1 4/2006 Nguyen
2006/0142086 A1 6/2006 Blackburn et al.
2006/0143085 A1 6/2006 Adams et al.
2006/0205457 A1 9/2006 Blackburn et al.
2006/0242072 A1 10/2006 Peled et al.
2007/0060381 A1 3/2007 Weiss
2007/0105613 A1 5/2007 Adams et al.
2007/0111787 A1 5/2007 Adams et al.
2007/0123332 A1 5/2007 Hishinuma et al.
2007/0123348 A1 5/2007 Nozaki
2007/0123349 A1 5/2007 Hishinuma et al.

FOREIGN PATENT DOCUMENTS

WO WO-03/045516 A1 5/2003
WO WO-03/045515 A1 6/2003
WO WO-03/045517 A1 6/2003
WO WO-03/3045518 A1 6/2003
WO WO-2004/004855 A1 1/2004
WO WO-2006/036536 A2 4/2006
WO WO-2007/092542 A2 8/2007

WO WO-2007092608 A2 8/2007
WO WO-2008/021079 A2 2/2008

OTHER PUBLICATIONS

"U.S. Appl. No. 10/629,110, Non Final Office Action mailed Jan. 24, 2007", 10 pgs.
"U.S. Appl. No. 10/629,110, Response filed Jul. 24, 2007 to Non Final Office Action mailed Jan. 24, 2007", 11 pgs.
"U.S. Appl. No. 10/629,110, Final Office Action Mailed Sep. 20, 2007", 10 pgs.
"U.S. Appl. No. 10/629,110, Response filed Feb. 20, 2008 to Final Office Action received Sep. 20, 2007", 11 pgs.
"U.S. Appl. No. 10/788,661, Final Office Action mailed Apr. 10, 2008", 21 Pgs.
"U.S. Appl. No. 10/788,661, Response filed Feb. 28, 2008 to Restriction Requirement mailed Nov. 28, 2007", 11 pgs.
"U.S. Appl. No. 10/788,661, Response filed Sep. 17, 2007 to Non-Final Office Action mailed Jun. 15, 2007", 16 pgs.
"U.S. Appl. No. 10/788,661, Restriction Requirement mailed Nov. 28, 2007", 4 pgs.
"U.S. Appl. No. 10/788,661, Non Final Office Action mailed Jun. 15, 2007", 11 pgs.
"U.S. Appl. No. 10/788,902, Final Office Action mailed May 17, 2007", 17 pgs.
"U.S. Appl. No. 10/788,902, Final Office Action mailed Aug. 6, 2008", 21 pgs.
"U.S. Appl. No. 10/788,902, Non Final Office Action mailed Nov. 21, 2006", 19 pgs.
"U.S. Appl. No. 10/788,902, Response filed Feb. 21, 2007 to Non Final Office Action mailed Nov. 21, 2006", 15 pgs.
"U.S. Appl. No. 10/788,902, Response filed Aug. 17, 2007 to Final Office Action mailed May 17, 2007", 13 pgs.
"U.S. Appl. No. 10/788,902, Response filed Apr. 30, 2008 to Non-Final Office Action Oct. 30, 2007", 13 pgs.
"U.S. Appl. No. 10/788,902, Non-Final Office Action mailed Oct. 30, 2007", 18 pgs.
"U.S. Appl. No. 10/788,903, Non-Final Office Action mailed Jan. 3, 2007", 21 pgs.
"U.S. Appl. No. 10/788,903, Non-Final Office Action mailed Jun. 28, 2007", 16 pgs.
"U.S. Appl. No. 10/788,903, Response filed Apr. 9, 2007 to Non Final Office Action mailed Jan. 3, 2007", 22 pgs.
"U.S. Appl. No. 10/788,903, Final Action mailed Dec. 31, 2007", 16 pgs.
"U.S. Appl. No. 10/788,903, Response filed Sep. 28, 2007 to Non-Final Office Action mailed Jun. 28, 2007", 13 pgs.
"U.S. Appl. No. 10/789,957, Non-Final Office Action mailed May 16, 2007", 27 pgs.
"U.S. Appl. No. 10/789,957, Response filed Aug. 16, 2007 to Non-Final Office Action mailed May 16, 2007", 17 pgs.
"U.S. Appl. No. 10/794,422, Response filed Nov. 19, 2007 to Non-Final Office Action mailed Jul. 18, 2007", 11 pgs.
"U.S. Appl. No. 10/794,422, Response filed Jul. 15, 2008 to Final Office Action mailed Feb. 15, 2008", 10 pgs.
"U.S. Appl. No. 10/794,422, Non-Final Office Action Mailed Jul. 18, 2007", 9 pgs.
"U.S. Appl. No. 10/794,422, Final Office Action mailed Feb. 15, 2008", 11 pgs.
"U.S. Appl. No. 10/794,423, Response filed Nov. 20, 2007 to Non-Final Office Action mailed Jul. 20, 2007", 12 pgs.
"U.S. Appl. No. 10/794,423, Response filed Jul. 15, 2008 to Final Office Action mailed Feb. 15, 2008", 12 pgs.
"U.S. Appl. No. 10/794,423, Non-Final Office Action Mailed Jul. 20, 2007", 10 pgs.
"U.S. Appl. No. 10/794,423, Final Office Action mailed Feb. 15, 2008", 7 pgs.
"U.S. Appl. No. 10/796,562, Non-Final Office Action mailed Nov. 27, 2007", 7 pgs.
"U.S. Appl. No. 10/796,562, Response filed May 27, 2008 to Non Final Office Action mailed Nov. 27, 2007", 10 pgs.
"U.S. Appl. No. 10/802,537, Non-Final Office Action mailed May 23, 2008", 25 pgs.
"U.S. Appl. No. 10/802,699, Non-Final Office Action mailed Sep. 27, 2007", 7 pgs.
"U.S. Appl. No. 10/802,699, Response filed Feb. 27, 2008 to Non-Final Office Action mailed Sep. 27, 2007", 9 pgs.
"U.S. Appl. No. 10/802,699, Final Office Action mailed Jul. 9, 2008", 12 pgs.
"U.S. Appl. No. 10/802,700, Response filed Mar. 12, 2008 to Non-Final Office Action mailed Sep. 12, 2008", 8 pgs.
"U.S. Appl. No. 10/802,700, Non-Final Office Action mailed Sep. 12, 2007", 7 pgs.
"U.S. Appl. No. 10/802,700, Final Office Action mailed Jul. 9, 2008", 13 Pgs.
"U.S. Appl. No. 10/802,701, Final Office Action mailed Aug. 22, 2008", 11 pgs.
"U.S. Appl. No. 10/802,701, Response filed Oct. 25, 2007 to Final Office Action mailed Jul. 25, 2007", 9 pgs.
"U.S. Appl. No. 10/802,701, Response filed May 12, 2008 to Non Final Office Action mailed Feb. 11, 2008", 10 pgs.
"U.S. Appl. No. 10/802,701, Final Office Action Mailed Jul. 25, 2007", 8 pgs.
"U.S. Appl. No. 10/802,701, Non-Final Office Action mailed Jan. 3, 2007", 9 pgs.
"U.S. Appl. No. 10/802,701, Response filed May 3, 2007 to Non-Final Office Action mailed Jan. 3, 2007", 12 pgs.
"U.S. Appl. No. 10/802,701, Non-Final Office Action mailed Feb. 11, 2008.", 13 pgs.
"U.S. Appl. No. 10/813,653, Non-Final Office Action mailed Nov. 7, 2007", 13 pgs.
"U.S. Appl. No. 10/813,653, Response filed Sep. 10, 2007 to Final Office Action mailed Jun. 8, 2007", 10 pgs.
"U.S. Appl. No. 10/813,653, Final Office Action mailed Jun. 8, 2007", 11 pgs.
"U.S. Appl. No. 10/813,653, Non-Final Office Action mailed Nov. 13, 2006", 10 pgs.
"U.S. Appl. No. 10/813,653, Response filed Feb. 13, 2007 to Non-Final Office Action mailed Nov. 13, 2006", 13 pgs.
"U.S. Appl. No. 10/813,653, Response filed May 7, 2008 to Non-Final Office Action mailed Nov. 7, 2007", 11 pgs.
"U.S. Appl. No. 10/824,780, Final Office Action mailed May 30, 2008", 14 pgs.
"U.S. Appl. No. 10/824,780, Non-Final Office Action mailed May 17, 2007", 12 pgs.
"U.S. Appl. No. 10/824,780, Response filed Aug. 6, 2007 to Non-Final Office Action mailed May 17, 2007", 17 pgs.
"U.S. Appl. No. 10/824,930, Response filed Jul. 24, 2008 to Final Office Action mailed Mar. 24, 2008", 15 pgs.
"U.S. Appl. No. 10/824,930, Final Office Action mailed Mar. 24, 2008.", 17 pgs.
"U.S. Appl. No. 10/824,930, Non-Final Office Action Mailed Aug. 10, 2007", 13 pgs.
"U.S. Appl. No. 10/824,930, Response filed Dec. 10, 2007 to Office Action Mailed Aug. 10, 2007", 15 pgs.
"U.S. Appl. No. 10/824,945, Response filed Aug. 26, 2008 to Non-Final Office Action mailed Feb. 26, 2008", 15 pgs.
"U.S. Appl. No. 10/824,945, Non-Final Office Action mailed Feb. 26, 2008", 15 pgs.
"U.S. Appl. No. 11/068,065, Final Office Action mailed Jan. 9, 2008", 15 pgs.
"U.S. Appl. No. 11/068,065, Non-Final Office Action mailed Apr. 22, 2008", 16 pgs.
"U.S. Appl. No. 11/068,065, Response filed Oct. 22, 2007 to Non-Final Office action mailed May 8, 2007", 11 pgs.
"U.S. Appl. No. 11/068,065 Non-Final Office Action mailed Apr. 20, 2007", 13 pgs.
"U.S. Appl. No. 11/068,065 Non-Final Office Action mailed May 8, 2007", 13 pgs.
"U.S. Appl. No. 11/068,065, Response filed Apr. 9, 2008 to Final Office Action mailed Jan. 9, 2008", 11 pgs.
"U.S. Appl. No. 11/143,874, Non-Final Office Action mailed May 13, 2008", 13 pgs.
"U.S. Appl. No. 11/143,874, Response filed Aug. 13, 2008 to Non Final Office Action mailed May 13, 2008", 12 pgs.

"U.S. Appl. No. 11/143,874, Response filed Aug. 24, 2007 to Final Office Action mailed Apr. 24, 2007", 9 pgs.
"U.S. Appl. No. 11/143,874, Response filed Feb. 12, 2008 to Non-Final Office Action Sep. 17, 2007", 12 pgs.
"U.S. Appl. No. 11/143,874, Non-Final Office Action mailed Sep. 17, 2007", 10 pgs.
"UDDI: FAQs", [online]. [archived Oct. 25, 2001]. Retrieved from the Internet: <URL: http://web.archive.org/web/20011024231452/http://uddi.org/faqs.html>, (2001), 10 pgs.
"International Application Serial No. PCT/US07/03341, International Search Report mailed Dec. 6, 2007", 2 pgs.
"International Application Serial No. PCT/US07/03341, Written Opinion mailed Dec. 6, 2007", 4 pgs.
"International Application Serial No. PCT/US07/03536, International Search Report mailed Nov. 19, 2007", 2 pgs.
"International Application Serial No. PCT/US07/03536, Written Opinion mailed Nov. 19, 2007", 6 pgs.
"Microsoft Message Queuing (MSMQ) Center", [online]. © 2003 Microsoft Corporation. [archived Jun. 8, 2003]. Retrieved from the Internet: <URL: http://web.archive.org/web/20030608223429/http://microsoft.com/windows2000/technologies/communications/msmq/default.asp>,(2003), 2 pgs.
"UDDI: Frequently Asked Questions", [online], © 2007, Microsoft Corporation, [retrieved Oct. 30, 2007]. Retrieved from the Internet: <URL: http://www.microsoft.com/windowsserver2003/evaluation/overview/dotnet/uddifaq.mspx> , 7 pgs.
"UDDI: Frequently Asked Questions", [online], © 2007, Microsoft Corporation, [retrieved Feb. 5, 2008]. Retrieved from the Internet: <URL: http://www.microsoft.com/windowsserver2003/evaluation/overview/dotnet/uddifaq.mspx>, 7 pgs.
Gottschalk, K., et al., "Introduction to Web Services Architecture", *IBM Systems Jouranl*;41(2), (2002), 170-177.
Ogbuji, U., "Using WSDL in SOAP Applications", *IBM developerWorks*: [online]. [archived Aug. 20, 2001]. Retrieved fron the Internet: <URL: http://web.archive.org/web/20010820205450/www-106.ibm.com/developerworks/webservies/library/ws-soap/index.html?dwzone=webservices>, (Nov. 2000), 5 pgs.
Prescod, P., "Second Generation Web Serviced", [online]. © 1998-2006, O'Reilly Media, Inc. Retrieved from the Internet: <URL: http://webservices.xml.com/lpt/a/915, (Feb. 6, 2002), 7 pgs.
Sabbouh, M., et al., "World Wide Web Consortium", *Workshop on Web Services*, (Apr. 11-12, 2001, San Jose, CA), (2001), 3 pgs.
Vasudevan, V., "A Web Services Primer", [online]. © 1998-2006, O'Reilly Media, Inc. Retrieved from the Internet: <URL: http://www.xml.com/lpt/a/760>, (Apr. 4, 2001), 10 pgs.
"U.S. Appl. No. 10/629,110, Advisory Action mailed Mar. 11, 2009", 3 pgs.
"U.S. Appl. No. 10/629,110, Appeal Brief filed Jun. 1, 2009", 30 pgs.
"U.S. Appl. No. 10/629,110, Decision on Appeal mailed Feb. 22, 2012", 7 pgs.
"U.S. Appl. No. 10/629,110, Examiner Interview Summary mailed Oct. 24, 2008", 2 pgs.
"U.S. Appl. No. 10/629,110, Final Office Action mailed Dec. 30, 2008", 14 pgs.
"U.S. Appl. No. 10/629,110, Notice of Allowance mailed Mar. 15, 2012", 5 pgs.
"U.S. Appl. No. 10/629,110, Response filed Mar. 2, 2009 to Final Office Action mailed Dec. 30, 2008", 22 pgs.
"U.S. Appl. No. 10/629,110, Response filed Mar. 30, 2009 to Advisory Action mailed Mar. 11, 2009", 1 pg.
"U.S. Appl. No. 10/629,110, Response filed Nov. 3, 2008 to Non Final Office Action mailed Jun. 3, 2008", 10 pgs.
"U.S. Appl. No. 10/802,537, Examiner Interview Summary mailed Oct. 24, 2008", 4 pgs.
"U.S. Appl. No. 10/802,537, Final Office Action mailed Feb. 5, 2009", 23 pgs.
"U.S. Appl. No. 10/802,537, Non Final Office Action mailed Mar. 29, 2011", 15 pgs.
"U.S. Appl. No. 10/802,537, Non-Final Office Action mailed Mar. 17, 2010", 25 pgs.
"U.S. Appl. No. 10/802,537, Response filed Jan. 18, 2011 to Non Final Office Action mailed Mar. 17, 2010", 9 pgs.
"U.S. Appl. No. 10/802,537, Response filed Oct. 23, 2008 to Non Final Office Action mailed May 23, 2008", 12 pgs.
"U.S. Appl. No. 10/802,537, Response filed Dec. 7, 2009 to Final Office Action mailed Feb. 5, 2009", 10 pgs.
"U.S. Appl. No. 11/143,874, Final Office Action mailed Apr. 24, 2007", 8 pgs.
"U.S. Appl. No. 11/143,874, Final Office Action mailed Dec. 24, 2008", 14 pgs.
"U.S. Appl. No. 11/143,874, Non Final Office Action mailed Jul. 14, 2006", 6 pgs.
"U.S. Appl. No. 11/143,874, Non-Final Office Action mailed Jun. 11, 2009", 14 pgs.
"U.S. Appl. No. 11/143,874, Notice of Allowance mailed Apr. 6, 2010", 10.
"U.S. Appl. No. 11/143,874, Response filed Mar. 24, 2009 to Final Office Action mailed Dec. 24, 2008", 9 pgs.
"U.S. Appl. No. 11/143,874, Response filed Oct. 12, 2006 to Non Final Office Action mailed Jul. 14, 2006", 7 pgs.
"U.S. Appl. No. 11/143,874, Response filed Dec. 11, 2009 to Non Final Office Action mailed Jun. 11, 2009", 12 pgs.
"U.S. Appl. No. 11/275,323, Final Office Action mailed Feb. 3, 2010", 11.
"U.S. Appl. No. 11/275,323, Non-Final Office Action mailed Jun. 24, 2009", 15 pgs.
"U.S. Appl. No. 11/275,323, Response filed Nov. 24, 2009 to Non Final Office Action mailed Jun. 24, 2009", 10 pgs.

* cited by examiner

WAGERING GAME SERVER AVAILABILITY BROADCAST MESSAGE SYSTEM

RELATED APPLICATIONS

This patent application is a U.S. National Stage Filing under 35 U.S.C. 371 from International Patent Application Ser. No. PCT/US2007/003536, filed Feb. 9, 2007, and published on Aug. 16, 2007 as WO 2007/092608 A2 and republished as WO 2007/092608 A3, which claims the priority benefit of U.S. Provisional Patent Application Ser. No. 60/743,259 filed Feb. 9, 2006 and entitled "HOST ADVERTISING PROTOCOL", and of U.S. Provisional Patent Application Ser. No. 60/743,902 filed Mar. 29, 2006 and entitled "WAGERING GAME NETWORK SERVER AVAILABILITY BROADCAST MESSAGE SYSTEM", the contents of which are incorporated herein by reference in their entirety.

FIELD OF THE INVENTION

The invention relates generally to computerized wagering game systems, and more specifically to wagering game systems operable to process a wagering game server broadcast signal.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, 2007, WMS Gaming, Inc.

BACKGROUND

Computerized wagering games have largely replaced traditional mechanical wagering game machines such as slot machines, and are rapidly being adopted to implement computerized versions of games that are traditionally played live such as poker and blackjack. These computerized games provide many benefits to the game owner and to the gambler, including greater reliability than can be achieved with a mechanical game or human dealer, more variety, sound, and animation in presentation of a game, and a lower overall cost of production and management.

The elements of computerized wagering game systems are in many ways the same as the elements in the mechanical and table game counterparts in that they must be fair, they must provide sufficient feedback to the game player to make the game fun to play, and they must meet a variety of gaming regulations to ensure that both the machine owner and gamer are honest and fairly treated in implementing the game. Further, they must provide a gaming experience that is at least as attractive as the older mechanical gaming machine experience to the gamer, to ensure success in a competitive gaming market.

Computerized wagering games do not rely on the dealer or other game players to facilitate game play and to provide an entertaining game playing environment, but rely upon the presentation of the game and environment generated by the wagering game machine itself. Incorporation of audio and video features into wagering games to present the wagering game, to provide help, and to enhance the environment presented are therefore important elements in the attractiveness and commercial success of a computerized wagering game system. Music and environmental effects are also played through speakers in some wagering game systems to enhance or complement a theme of the wagering game. These sounds typically accompany video presentation of the wagering game on a screen, which itself often includes animation, video, and three-dimensional graphics as part of presentation of the wagering game.

Many computerized wagering game systems are coupled via a network, so that the games can communicate with a server or with one another. In one such example, a central server performs a variety of functions such as accounting, providing updated software to the wagering game systems, and coordinating group games such as progressive slot games.

But, configuration of a wagering game machine on a network requires a degree of configuration and setup beyond simply plugging in a traditional wagering game machine and turning it on. Managing configuration of a wagering game network and the associated devices is therefore an important element of operating a wagering game facility.

SUMMARY

One example embodiment of the invention comprises a computerized wagering game system includes a gaming module operable to conduct a wagering game on which monetary value can be wagered, and a network module operable to detect a wagering game network server availability broadcast signal. Another embodiment comprises a wagering game network server operable to broadcast a wagering game server availability signal over a wagering game network.

DETAILED DESCRIPTION

In the following detailed description of example embodiments of the invention, reference is made to specific example embodiments of the invention by way of drawings and illustrations. These examples are described in sufficient detail to enable those skilled in the art to practice the invention, and serve to illustrate how the invention may be applied to various purposes or embodiments. Other embodiments of the invention exist and are within the scope of the invention, and logical, mechanical, electrical, and other changes may be made without departing from the subject or scope of the present invention. Features or limitations of various embodiments of the invention described herein, however essential to the example embodiments in which they are incorporated, do not limit other embodiments of the invention or the invention as a whole, and any reference to the invention, its elements, operation, and application do not limit the invention as a whole but serve only to define these example embodiments. The following detailed description does not, therefore, limit the scope of the invention, which is defined only by the appended claims.

In one example embodiment of the invention, a computerized wagering game system includes a gaming module operable to conduct a wagering game on which monetary value can be wagered, and a network module operable to detect a wagering game network server availability broadcast signal. In a further example, the network module connects to the wagering game network server identified in the availability broadcast signal, and authenticates the identity of the wagering game network server. Other embodiments of the invention include wagering game servers operable to broadcast wagering game network server availability messages; and systems comprising such servers and networked wagering game systems.

Figure 1:
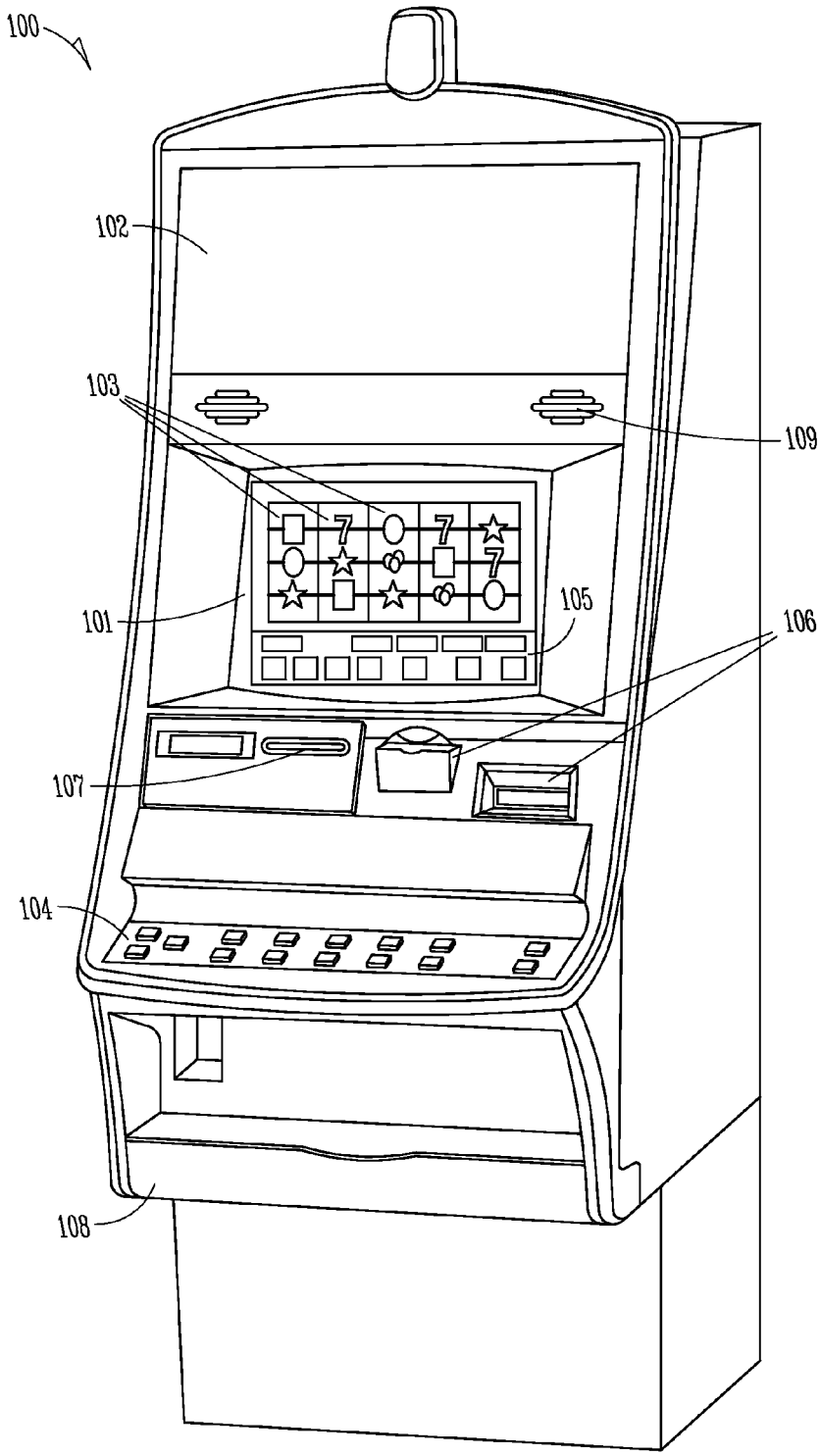
FIG. 1 shows a computerized wagering game machine, as may be used to practice some embodiments of the invention.

FIG. 1 illustrates a computerized wagering game machine, as may be used to practice some embodiments of the present invention. The computerized gaming system shown generally at 100 is a video wagering game system, which displays information for at least one wagering game upon which monetary value can be wagered on video display 101. Video display 101 is in various embodiments a CRT display, a plasma display, an LCD display, a surface conducting electron emitter display, or any other type of display suitable for displaying electronically provided display information. In some further embodiments, additional displays such as a bonus game display or top box display 102 are further operable to display electronically provided information to a wagering game player. Alternate embodiments of the invention will have other game indicators, such as mechanical reels instead of the video graphics reels shown at 103 that comprise a part of a video slot machine wagering game.

A wagering game is implemented using software within the wagering game machine, such as through instructions stored on a machine-readable medium such as a hard disk drive or nonvolatile memory. In some further example embodiments, some or all of the software stored in the wagering game machine is encrypted or is verified using a hash algorithm or encryption algorithm to ensure its authenticity and to verify that it has not been altered. For example, in one embodiment the wagering game software is loaded from nonvolatile memory in a compact flash card, and a hash value is calculated or a digital signature is derived to confirm that the data stored on the compact flash card has not been altered. The game of chance implemented via the loaded software takes various forms in different wagering game machines, including such well-known wagering games as reel slots, video poker, blackjack, craps, roulette, or hold 'em games. In some further embodiments, a secondary game or bonus game is displayed on the secondary display 102, or other information such as progressive slot information or other community game information is displayed.

The wagering game is played and controlled with inputs such as various buttons 104 or via a touchscreen overlay to video screen 101. The touchscreen is used in some embodiments to display virtual buttons, which can have unique functions in some embodiments, or can duplicate the functions provided by the mechanical buttons 104 in other embodiments. In some alternate examples, other devices such as pull arm 105 used to initiate reel spin in this reel slot machine example are employed to provide other input interfaces to the game player. The player interface components are in this example contained within or mechanically coupled to the wagering game system, but in other embodiments will be located outside the wagering game system cabinet such as by a wired or wireless electronic connection to the wagering game system.

Monetary value is typically wagered on the outcome of the games, such as with tokens, coins, bills, or cards that hold monetary value. The wagered value is conveyed to the machine such as through a changer 106 or a secure user identification module interface 107, and winnings are returned such as via a returned value ticket, a stored value card, or through the coin tray 108. Sound is also provided through speakers 109, typically including audio indicators of game play, such as reel spins, credit bang-ups, and environmental or other sound effects or music to provide entertainment consistent with a theme of the computerized wagering game. In some further embodiments, the wagering game machine is coupled to a network, and is operable to use its network connection to receive wagering game data, track players and monetary value associated with a player, and to perform other such functions.

In other embodiments, the computerized wagering game system takes one or more other forms, such as a mobile or portable wagering game device, a server-based wagering game device, or a networked wagering game system. These other computerized wagering game system embodiments need not contain all features of the wagering game system of FIG. 1, which does not limit the scope of a computerized wagering game but is provided as an example only.

Figure 2:
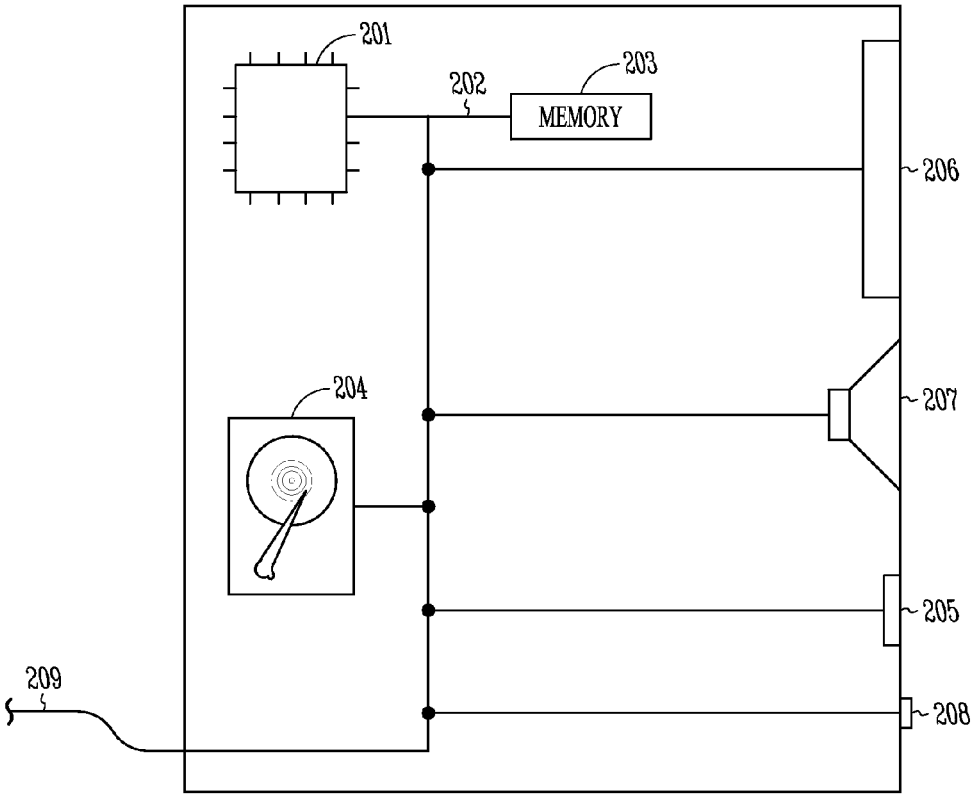
FIG. 2 is a block diagram of a computerized wagering game machine as may be used to practice some embodiments of the invention.

FIG. 2 shows a block diagram of an example embodiment of a wagering game system. The wagering game system includes a processor 201, which is sometimes called a microprocessor, controller, or central processing unit (CPU). In some embodiments, more than one processor is present, or different types of processors are present in the wagering game system, such as using multiple processors to run gaming code, or using dedicated processors for audio, graphics, security, or other functions. The processor is coupled via a bus 202 to various other components, including memory 203 and nonvolatile storage 204. The nonvolatile storage is able to retain the data stored therein when power is removed, and in various embodiments takes the form of a hard disk drive, nonvolatile random access memory such as a compact flash card, or network-coupled storage. Further embodiments include additional data storage technologies, such as compact disc, DVD, or HD-DVD storage in the wagering game system.

The bus 202 also couples the processor and components to various other components, such as a value acceptor 205, which is in some embodiments a token acceptor, a card reader, or a biometric or wireless player identification reader. A touchscreen display 206 and speakers 207 serve to provide an interface between the wagering game system and a wagering game player, as do various other components such as buttons 208, pullarms, and joysticks. These components are located in a wagering game machine cabinet such as that of FIG. 1 in some embodiments, but can be located in multiple enclosures comprising a wagering game system or outside a wagering game machine cabinet in other embodiments, or in alternate forms such as a wireless or mobile device.

In operation, the wagering game system loads program code from nonvolatile storage 204 into memory 203, and the processor 201 executes the program code to cause the wagering game system to perform desired functions such as to present a wagering game upon which monetary value can be wagered. This and other functions are provided by various modules in the computerized system such as an audio module, a game presentation module, or a touchscreen display module, where such modules comprise in some embodiments hardware, software, mechanical elements, manual intervention, and various combinations thereof.

A network connection 209 enables the wagering game system to communicate with other wagering game network devices, such as a progressive slot area controller or other community game server, an accounting server operable to monitor the security and game activity on wagering game machines, and a game server operable to send game code, multimedia, or other such content to wagering game machines. Connection with the wagering game network servers is typically performed by network methods such as an Ethernet connection, a wireless network connection, or other such connection to facilitate exchange of data.

Figure 3:
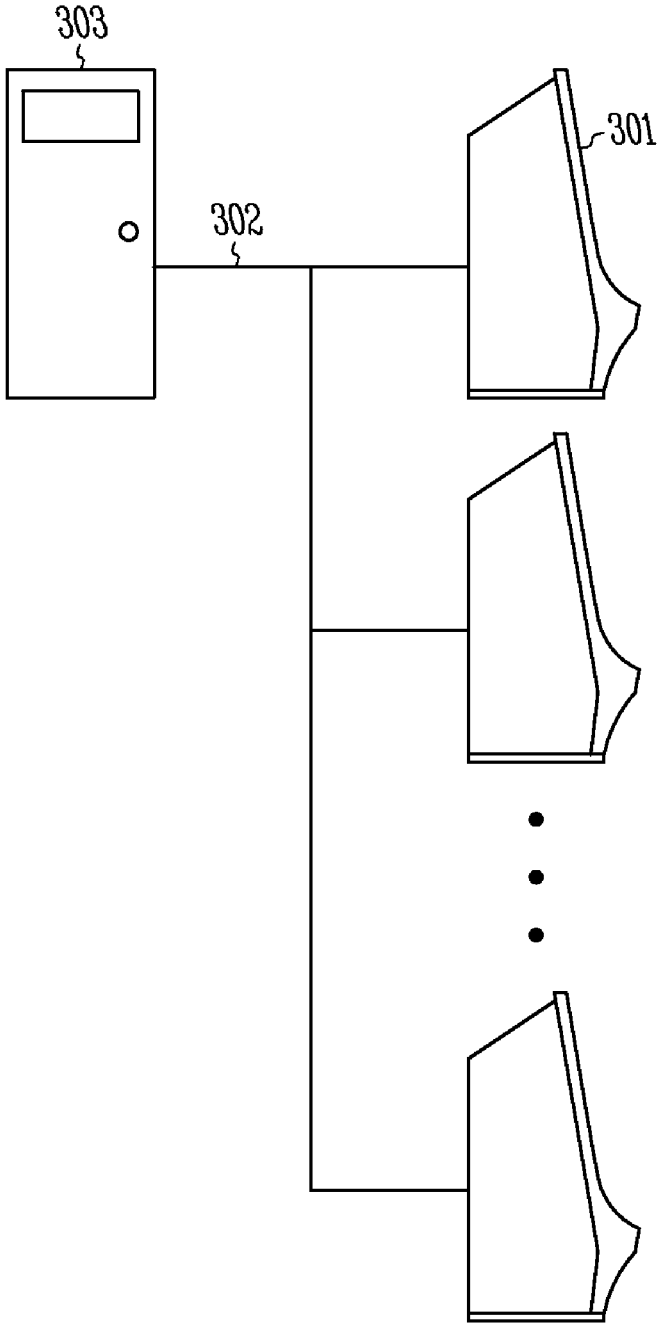
FIG. 3 is a diagram of a wagering game system network comprising a wagering game network server and wagering game machines, as may be used to practice some embodiments of the invention.

FIG. 3 shows one such example wagering game network. The wagering game machines 301 on the network 302 become aware of the host or wagering game machine server 303 in one embodiment of the invention by receiving a broadcast or multicast signal from the wagering game server. The signal in one embodiment comprises a network message that identifies the wagering game server, and is received in a wagering game machine 301. The wagering game machine 301 in one such embodiment simply monitors the network for a wagering game system availability broadcast message, and upon receiving one establishes communication with the wagering game server and becomes a part of the wagering game network.

The wagering game machine 301 in some embodiments will not present a wagering game until communication has been established with a wagering game server 303, so that any accounting, tilt, update, configuration, or other such information that is desirably exchanged between the wagering game machine 301 and the wagering game network server 303 before game play can be conducted.

In some further embodiments, the network connection 302 between the wagering game machines 301 and the wagering game network server 303 is encrypted or secured, such as by a negotiated secure connection, or by use of a security certificate or digital signature provided by the wagering game server. In embodiments where the wagering game server's broadcast availability message contains a certificate or digital signature, the authenticity of the wagering game server can be confirmed in the wagering game machine 301 before communication is started.

In some embodiments, multiple wagering game servers 303 are present on the wagering game network 302, and communicate with fixed wagering game machines 301, mobile wagering game machines, and other computerized network devices. A message protocol such as Game-to-System (G2S), Best of Breed (BOB), SuperSAS, or any other suitable protocol is used to exchange various types of data between wagering game machines and wagering game network servers. Each wagering game machine may be configured to communicate with only certain wagering game network servers, and will in some such embodiments maintain a list of wagering game network servers with which the wagering game machine should communicate. Broadcast messages from wagering game network servers other than those with which a wagering game machine is configured to communicate will be disregarded in some such embodiments, and the wagering game machine will continue to monitor the network for configured wagering game network servers.

Figure 4:
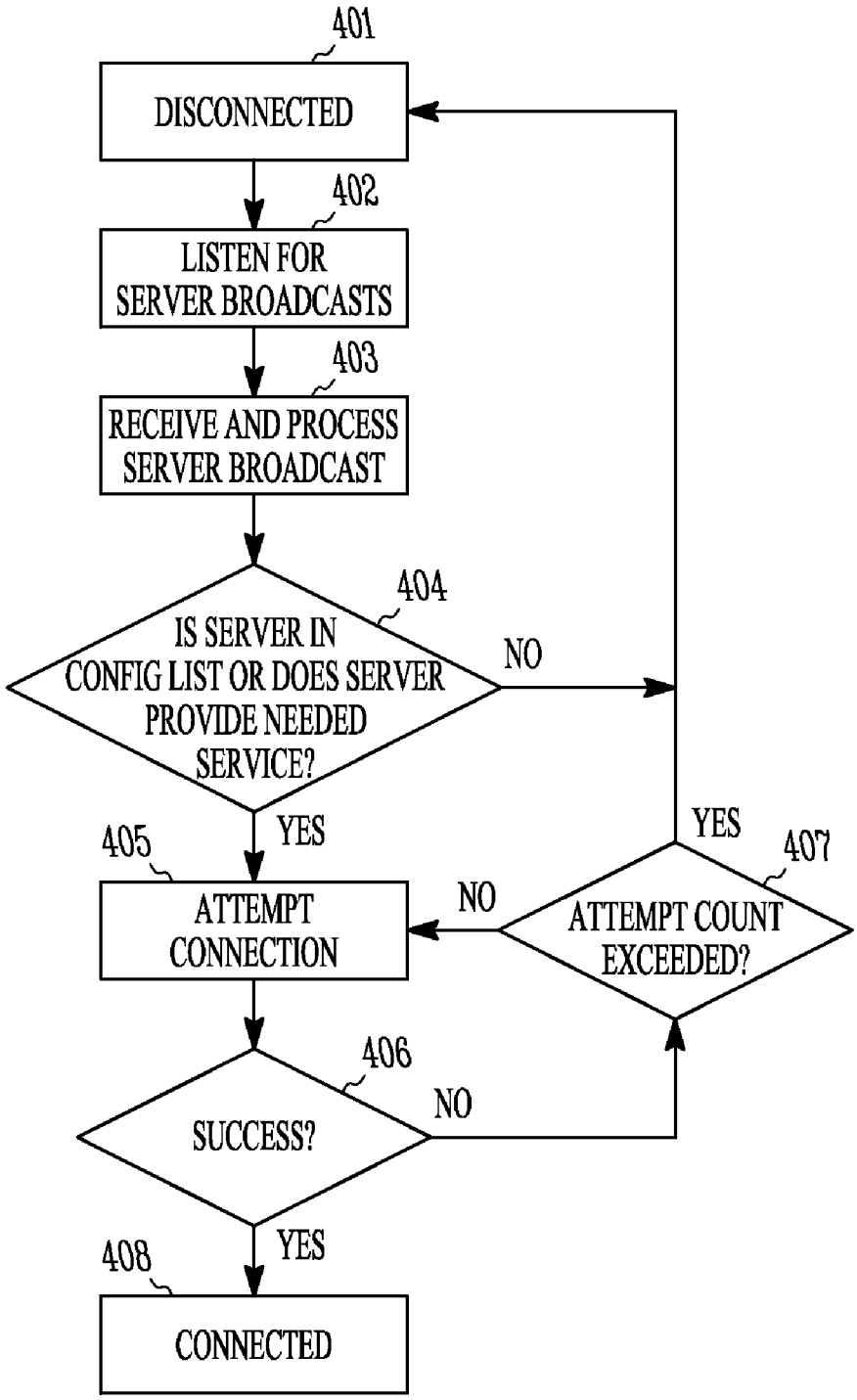
FIG. 4 is a flowchart of a method of processing wagering game network server broadcast availability messages in which the wagering game machine listens for broadcast messages before attempting a connection, consistent with an example embodiment of the invention.

FIG. 4 is a flowchart illustrating one example method of use of server availability broadcast signals to reestablish communications between a wagering game machine and a server. At 401, the wagering game machine is disconnected, and has lost its ability to communicate with the server over a network connection. When connected, the wagering game machine is able in various embodiments to provide accounting information, exchange player tracking information, download game software or other software, media, and firmware, participate in a community game such as progressive area slot game, and to perform other such functions over the network.

Loss of the network connection may be the result of any of a variety of network problems such as a failed router or switch, a rebooting server, a wagering game machine fault or reboot, or a disconnected or noisy network connection. In some embodiments, a network interface adapter in the wagering game machine is able to detect that the network connection has failed, and is able to report the circumstances or conditions surrounding the failure to other wagering game machine hardware and software.

When the wagering game machine detects that the network connection is broken, it begins to listen for server broadcasts at 402. When a server availability broadcast signal is received, it is processed at 403. In one embodiment, the wagering game machine verifies the identity of the wagering game machine, such as by using a digital signature embedded in the broadcast message, and determines whether communication with the identified server is desired. This can also be achieved in another example by use of a configuration table, listing each of the servers with which the wagering game machine is configured to communicate. If the server identified in the server availability broadcast is a server with which the wagering game machine wishes to communicate or is determined to provide a needed service at 404, a connection is attempted at 405.

Once the broadcast message has been processed and the wagering game system has determined that the message is from a valid wagering game server and that the wagering game machine should establish a connection to the server, the wagering game machine attempts to connect to the server at 405. In some embodiments where the connection to the wagering game network server is not immediately successful, the wagering game machine will again try at various intervals, various numbers of times, and using other varying parameters to make repeated attempts to connect with the wagering game server. If processing the broadcast message reveals that the wagering game network server is not one to which the wagering game machine wishes to connect, the wagering game machine continues to listen for wagering game server broadcast messages at 402.

If the attempts to connect to the wagering game server at 405 are determined to be successful at 406, the wagering game system enters a connected state at 408 and is operable to exchange data with the server via the network connection. If the connection attempt is unsuccessful, reconnection is retried until a reconnection attempt count has been exceeded as determined at 407, at which point the wagering game machine returns to 402 and listens for server broadcast availability messages from other servers.

In some embodiments such as where the network connection is noisy or a network element has an intermittent failure, multiple disconnections and reconnections can happen over a short period of time. The number of reconnections, or the interval between reconnection attempts, is limited in some such embodiments to a certain number, is configurable, or changes over time as the wagering game machine continues to try to establish a network connection.

Once the wagering game machine's efforts to reconnect have failed a certain number of times, for a certain amount of time, or according to some other such criteria at 407, the wagering game system listens for a wagering game network server broadcast signal at 402 from either another network server offering the same service, or for the same server in hopes that an intermittent problem such as a reboot have remedied the previous network communications problems. In this state, the wagering game machine monitors the network, listening for a signal from another system that can be identified as a wagering game server, such as by the content of the broadcast signal or by comparison with a list of known wagering game servers on the network. Certain features of the wagering game machine, such as player tracking or other features, may be suppressed while the wagering game continues to operate in some embodiments. In another example embodiment, the wagering game machine stops game play until a network connection can be reestablished, including some embodiments in which the wagering game machine presents the results of a wagering game whose outcome is determined on a central server.

The flowchart of FIG. 4 is altered in some embodiments such that a wagering game machine can operate in more than one of the shown states at a time. For example, a wagering game machine may continue to listen for broadcasts as shown at 402 while in the normal connected mode shown at 408. Similarly, the wagering game machine may continue to listen for broadcast messages from servers at 402 while attempting to connect to servers already discovered at 405. The wagering game system may be considered to be in a disconnected state as is shown at 401 while listening for a wagering game server at 402 such as where no server connection has yet been established, again resulting in multiple states being applicable at a single time.

Figure 5:
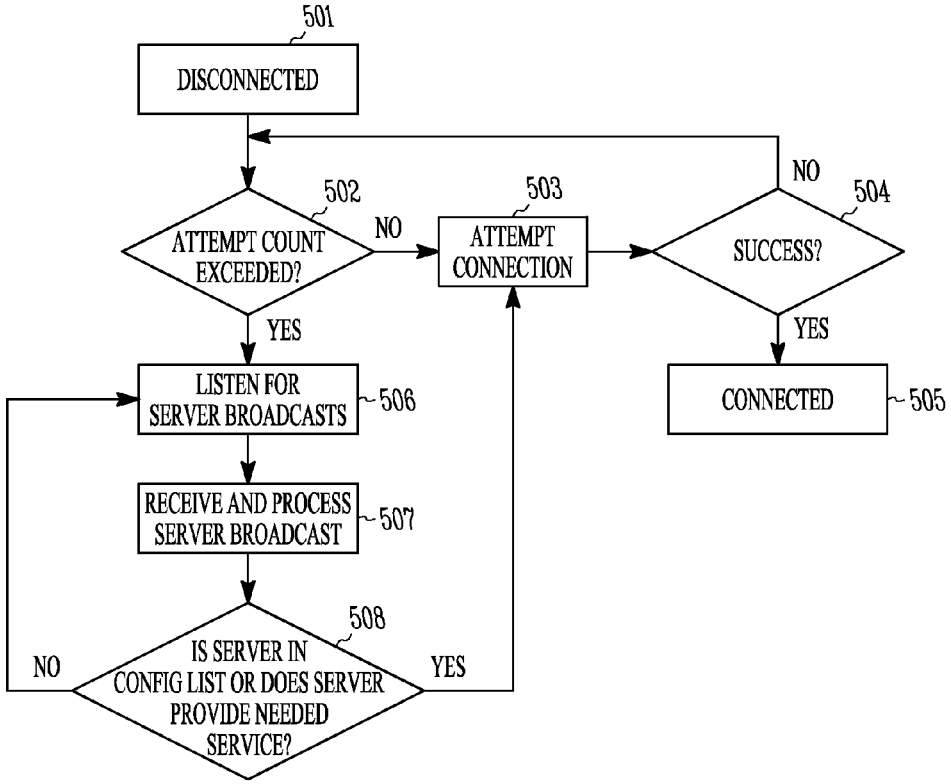
FIG. 5 is a flowchart of a method of processing wagering game network server broadcast availability messages in which the wagering game machine may attempt to establish a connection before listening for broadcast messages, consistent with an example embodiment of the invention.

FIG. 5 is an alternate embodiment of an example method of use of server availability broadcast signals to reestablish communications between a wagering game machine and a server, in which the wagering game system attempts reconnection before using server availability broadcast messages to establish a server connection. The computerized wagering game machine again detects that it is disconnected or has become disconnected from one or more wagering game network servers at 501. This is achieved in various embodiments by use of a software or hardware monitoring process, such as a hardware network interface that monitors the status of a network connection and a software module that works with the network hardware interface to monitor the network connection status. In other embodiments, the network connection remains functional, but similar combinations of hardware and software are used to detect loss of a connection to some but not all network connections.

At 502, the wagering game system determines whether a reconnection count threshold has been established and exceeded before trying to reconnect with the lost server at 503. Threshold examples include a limit to the number of attempts, or the time during which a wagering game machine makes continuous attempts, in reconnecting with the wagering game machine server. In one such example, a wagering game machine attempts reconnection continuously for the first 45 seconds after losing a connection, and attempts to reconnect at one minute intervals for the half hour thereafter. After half an hour, the machine attempts to reconnect at five minute intervals until it is reconnected, or simply listens to network traffic for a broadcast message from the server as shown at 506.

The thresholds can be predetermined or preconfigured by the wagering game machine manufacturer, but in other embodiments will be configurable such that a wagering game machine owner or administrator can configure the wagering game machine to operate as desired. In one such example, a wagering game network owner with a small network or a network transitioning to a networked wagering game machine environment may wish to have a machine attempt reconnection at a more relaxed pace than a wagering game facility that relies on the network for credit management through a networked player tracking system. In another example, a wagering game establishment owner may wish to configure machines to operate in a limited mode if the network connection is lost, while other establishment owners may wish to configure their machines to stop conducting wagering games and to display an error message if the network connection is lost.

If the reconnection attempt is successful, normal connected operation resumes at 505, but if the reconnection attempts are unsuccessful, repeated attempts to connect are made as shown at 502, 503, and 504 until the reconnection attempt count has been exceeded.

Once the reconnection attempt count is determined to be exceeded at 502, the wagering game machine listens for server availability message broadcasts at 506. A broadcast message comprises in one embodiment a message sent from the wagering game network server with more than one specified recipient, or with no specified recipient. When a server availability broadcast message is received, it is processed as shown at 507, and if the server is in the configuration list or provides a needed service a connection attempt is made at 503. The broadcast message identifies the server in some embodiments, and identifies server characteristics such as the server function in further embodiments. The wagering game machines in some embodiments maintain a list of wagering game network servers with which the machines communicate, such as by maintaining the Internet Protocol (IP) address of a game content server, a player tracking server, and an accounting server in one example embodiment. If the server doesn't provide a needed service and is not on the wagering game machine's configured server list, the wagering game system resumes listening for server broadcasts at 506.

In a further embodiment, the wagering game machine is able to authenticate the identity of the wagering game server by analyzing a digitally signed message or a digital certificate signed by a trusted authority, such as a wagering game system manufacturer or server software manufacturer. The identity of the server can thereby be confirmed to a relatively high degree of certainty, providing security for communication of wagering game information such as accounting or player tracking data that may be exchanged between wagering game machines and servers in a wagering game network.

If the server broadcast availability message is from a server to which the wagering game machine wishes to connect, the odds of a successful reconnection are high, as the broadcast message from the server indicates that the server is operational and the network connection linking the server to the wagering game machine is operational.

For this reason, wagering game network servers send broadcast messages over the network regularly after rebooting or detecting reconnection to a wagering game network. As the wagering game network server continues to operate normally while attached to the network, the frequency of broadcast messages can be reduced, because the likelihood of wagering game machines waiting to reattach to the server is reduced.

In some embodiments, attempting to connect to a server identified at 507 and 508 is also subject to a connection attempt counter. In such embodiments, an attempt to connect to a discovered server at 503 that is determined to have failed at 504 will result in processing at 502 to determine whether a connection attempt count has been exceeded. Once the connection attempt count has been reached, the process returns to 506 so that alternate servers can be discovered.

The example of FIG. 5 differs from that of FIG. 4 in that attempts to reconnect to a lost server are made repeatedly if the reconnect attempt count limit is set to a number other than zero or one, which may result in reestablishing communications with a server more quickly than could be achieved using a broadcast availability message scheme. In other embodiments where a server connection has suffered more than an intermittent failure, attempts to establish a server connection using server availability broadcast messages will likely result in a more rapid network server connection.

Figure 6:
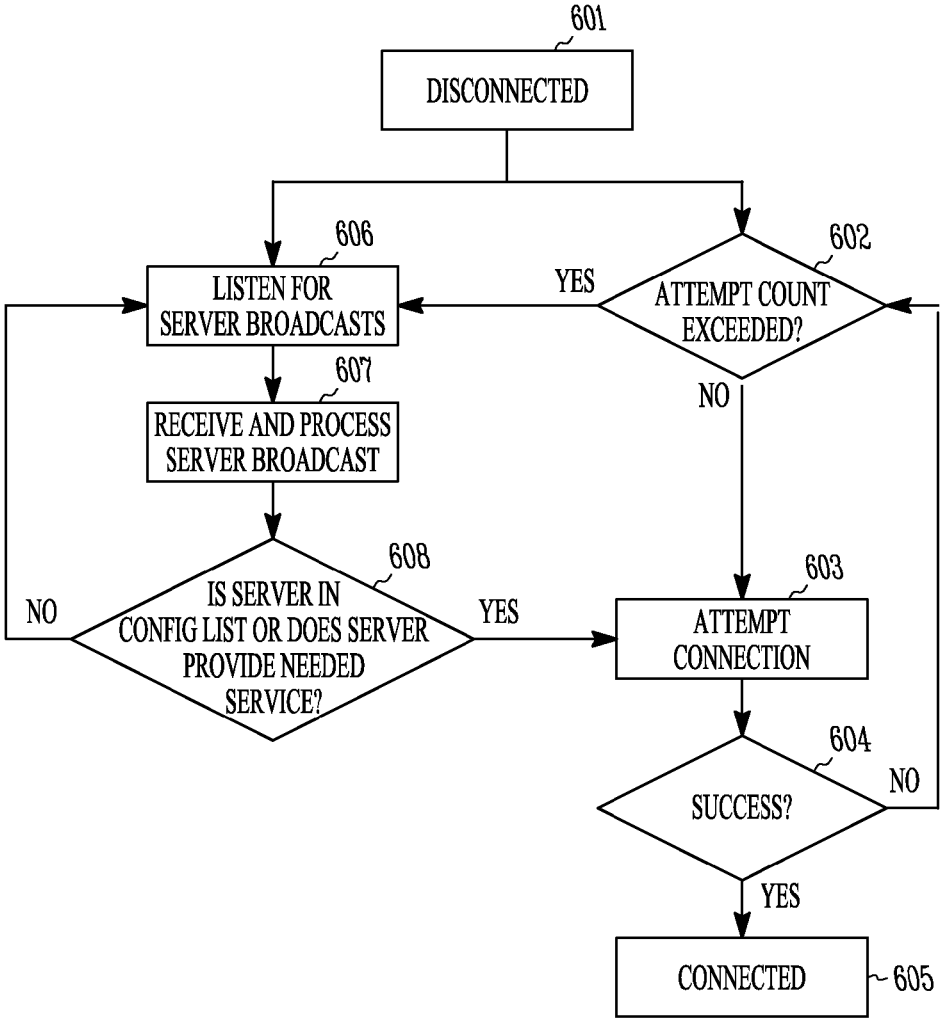
FIG. 6 is a flowchart of a method of processing wagering game network server broadcast availability messages in which the methods of FIGS. 4 and 5 are conducted in parallel, consistent with an example embodiment of the invention.

FIG. 6 is an example of a method that uses both methods in parallel, realizing the advantages of each method in rapidly reestablishing a server connection. A server connection is again initially lost or is not yet established at 601. At 602, the wagering game machine determines whether a connection attempt count has been exceeded, and proceeds to attempt connection at 603, much as in the example of FIG. 5. If the connection is determined to be successful at 604, the wagering game machine enters a normal operational state at 605. If the connection attempt fails, the machine attempts reconnection at 603 as long as the attempt count is determined not to have been exceeded at 602.

At the same time as the reconnection process is proceeding in elements 602-605, the wagering game machine is monitoring its network adapter for server broadcast availability messages at 606. If a broadcast availability message is detected, it is received and processed at 607. If the detected server provides a needed service or is on the wagering game machine's server configuration list at 608, a connection is attempted at 603. If a connection to the identified server is not desired, the wagering game system resumes listening for server availability broadcast messages at 606.

In this example, the elements 606 and following can occur at the same time as the elements 602 and following, enabling the wagering game machine to pursue both the process of connection or reconnection to an identified server and the process of listening for server availability broadcast messages at the same time. When one of the two processes switches to the other process, such as when a connection count is exceeded at 602 or a wagering game server is identified for connection at 608, one of the two processes can execute elements of the other process, either as a single process or in addition to the one or more parallel processes already being run, and may or may not return to its original process elements. For example, while a first process is listening for server broadcasts, receiving and processing them, and determining that they do not identify a server to which the wagering game system needs to connect at 606-608, a separate connection process may enter the listening process 606 as a result of connection attempts exceeded at 602 and return to connection attempts at 603 due to a server being identified at 608. In further embodiments, more than one or two processes may execute at the same time, and processes may join one another or split.

These examples illustrate how various example embodiments of a wagering game machine can use broadcast messages from a wagering game network server to establish a connection or reconnect to the server after a disruption in network communication. The examples presented show how such a system can be used to recover from common faults such as a rebooting server, a network that has been temporarily disconnected, or a failure in network hardware such as a network adapter, switch, or router. Examples of attempting reconnection and listening for server availability broadcast messages in various orders or in parallel have illustrated by way of example some ways in which various embodiments of the invention may be practiced.

Although specific embodiments have been illustrated and described herein, it will be appreciated by those of ordinary skill in the art that any arrangement that achieve the same purpose, structure, or function may be substituted for the specific embodiments shown. This application is intended to cover any adaptations or variations of the example embodiments of the invention described herein. It is intended that this invention be limited only by the claims, and the full scope of equivalents thereof.

The invention claimed is:

1. A computerized wagering game system, comprising:
- a gaming module operable to present a wagering game on which monetary value can be wagered; and
- a network module operable to
  - detect a loss of a network connection to a wagering game network server;
  - attempt to reconnect to the wagering game network server; and
  - when reconnection fails, then:
    - monitor the network connection to detect a wagering game network server availability broadcast signal that was broadcasted from the wagering game network server to a plurality of computerized wagering game systems; and
    - upon receiving the wagering game network server availability broadcast signal:
      - access a list of approved wagering game servers;
      - determine whether the wagering game network server is in the list of approved wagering game servers; and
      - establish a connection with the wagering game network server when it is determined that the wagering game network server is in the list of approved wagering game servers,
- wherein the computerized wagering game system functions as a client device to the wagering game network server.

2. The computerized wagering game system of claim 1, wherein the network module is further operable to recognize whether the wagering game network server availability signal is from an authentic wagering game network server, and to add the wagering game network server to a wagering game network server list if it is authentic.

3. The computerized wagering game system of claim 2, wherein recognizing whether the wagering game network server availability signal is from an authentic wagering game network server comprises evaluating at least one of a digital signature and an authentication certificate from the wagering game network server.

4. The computerized wagering game system of claim 1, wherein the wagering game system is operable to communicate at least one of accounting information, wagering game content information, community game information, and game presentation software over the network with the wagering game network server.

5. A method of operating a computerized wagering game system, comprising:

presenting a wagering game on which monetary value can be wagered;

detecting, by the computerized wagering game system, a loss of a network connection to a wagering game network server;

attempting to reconnect to the wagering game network server; and when reconnection fails, then:

monitoring the network connection to detect a wagering game network server availability broadcast signal that was broadcasted from the wagering game network server to a plurality of computerized wagering game systems; and upon receiving the wagering game network server availability broadcast signal:

accessing a list of approved wagering game servers;

determining whether the wagering game network server is in the list of approved wagering game servers; and establishing a connection with the wagering game network server when it is determined that the wagering game network server is in the list of approved wagering game servers, wherein the computerized wagering game system functions as a client device to the wagering game network server broadcasting the wagering game network server availability broadcast signal.

6. The method of operating a computerized wagering game system of claim 5, further comprising recognizing whether the wagering game network server availability signal is from an authentic wagering game network server, and adding the wagering game network server to a wagering game network server list if it is authentic.

7. The method of operating a computerized wagering game system of claim 6, wherein recognizing whether the wagering game network server availability signal is from an authentic wagering game network server comprises evaluating at least one of a digital signature and an authentication certificate from the wagering game network server.

8. The method of operating a computerized wagering game system of claim 5, further comprising communicating at least one of accounting information, wagering game content information, community game information, and game presentation software over the network with the wagering game network server.

9. A non-transitory machine-readable medium with instructions stored thereon, the instructions when executed operable to cause a computerized wagering game machine to:

present a wagering game on which monetary value can be wagered;

detect a loss of a network connection to a wagering game network server;

attempt to reconnect to the wagering game network server; and when reconnection fails, then:

monitor the network connection to detect a wagering game network server availability broadcast signal that was broadcasted from the wagering game network server to a plurality of computerized wagering game systems; and upon receiving the wagering game network server availability broadcast signal:

access a list of approved wagering game servers;

determine whether the wagering game network server is in the list of approved wagering game servers;

establish a connection with the wagering game network server when it is determined that the wagering game network server is in the list of approved wagering game servers; and function as a client device to a wagering game network server broadcasting the wagering game network server availability broadcast signal.

10. The machine-readable medium of claim 9, the instructions further operable when executed to cause the computerized wagering game system to recognize whether the wagering game network server availability signal is from an authentic wagering game network server, and adding the wagering game network server to a wagering game network server list if it is authentic.

11. The machine-readable medium of claim 10, wherein recognizing whether the wagering game network server availability signal is from an authentic wagering game network server comprises evaluating at least one of a digital signature and an authentication certificate from the wagering game network server.

12. The machine-readable medium of claim 9, the instructions further operable when executed to cause the computerized wagering game system to communicate at least one of accounting information, wagering game content information, community game information, and game presentation software over the network with the wagering game network server.

* * * * *

UNITED STATES PATENT AND TRADEMARK OFFICE

CERTIFICATE OF CORRECTION

PATENT NO. : 8,360,887 B2
APPLICATION NO. : 12/278842
DATED : January 29, 2013
INVENTOR(S) : Dale R. Buchholz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1175 days.

Signed and Sealed this
First Day of September, 2015

Michelle K. Lee

Michelle K. Lee
*Director of the United States Patent and Trademark Office*